United States Patent [19]

Yokoyama et al.

[11] Patent Number: 4,715,807

[45] Date of Patent: Dec. 29, 1987

[54] PULSE COMBUSTION DEVICE

[75] Inventors: Nobuyoshi Yokoyama; Tsuneyasu Hayakawa, both of Nagoya, Japan

[73] Assignee: Paloma Kogyo Kabushiki Kaisha, Nagoya, Japan

[21] Appl. No.: 7,204

[22] Filed: Jan. 27, 1987

[30] Foreign Application Priority Data

Jan. 28, 1986 [JP] Japan ..... 61-10627[U]

[51] Int. Cl.[4] ..... F23C 11/04

[52] U.S. Cl. ..... 431/1; 60/39.77; 60/39.8

[58] Field of Search ..... 431/1, 158; 122/24; 60/39.76, 39.77, 39.8

[56] References Cited

U.S. PATENT DOCUMENTS

| | | | |
|---|---|---|---|
| 2,898,978 | 8/1959 | Kitchen et al. | 60/39.77 X |
| 3,005,485 | 10/1961 | Salgo et al. | 60/39.77 X |
| 3,091,224 | 5/1963 | Rydberg | 431/1 X |
| 4,309,977 | 1/1982 | Kitchen | 431/1 X |
| 4,472,132 | 9/1984 | Hisaoka et al. | 431/1 |

FOREIGN PATENT DOCUMENTS

| | | | |
|---|---|---|---|
| 0157372 | 10/1985 | European Pat. Off. | 431/1 |
| 1240612 | 5/1967 | Fed. Rep. of Germany | 431/1 |

*Primary Examiner*—Margaret A. Focarino
*Attorney, Agent, or Firm*—Berman, Aisenberg & Platt

[57] ABSTRACT

In a pulse combustion device including a housing forming therein a combustion chamber, a cylindrical support member joined to the housing to form a mixing chamber in open communication with the combustion chamber, an annular perforated flange member coupled with an open end of the support member, a cylindrical member mounted in the center of the flange member to form a gas passage in open communication with the mixing chamber, a flapper-type air inlet valve assembly mounted on the flange member, and a flapper-type gas inlet valve assembly disposed within the cylindrical member. The air inlet valve assembly includes an annular valve plate formed with a plurality of circumferentially equi-spaced circular air ports and being secured to annular end surfaces of the flange member and the cylindrical member, and a plurality of circumferentially equi-spaced air inlet valve units mounted on the valve plate on a common circular path concentric with the gas passage. The air inlet valve units each includes a circular perforated backer plate arranged within the mixing chamber to oppose each of the air ports and fixed to the valve plate through a spacer, and a circular air flapper movable between the valve plate and the backer plate.

5 Claims, 4 Drawing Figures

PULSE COMBUSTION DEVICE

BACKGROUND OF THE INVENTION

1. Field of the Invention

The present invention relates to pulse combustion devices using flapper-type gas and air inlet valves, and more particularly to an improvement of a flapper-type air inlet valve assembly in the pulse combustion device.

2. Description of the Prior Art

In a conventional pulse combustion device of this kind, flapper-type gas and air inlet valves are adapted to supply gaseous fuel and air into a combustion chamber, and a tailpipe is connected to the combustion chamber to take place therein resonant combustion of the mixture of gaseous fuel and air and to exhaust therefrom the combustion products. In FIGS. 3 and 4 there is illustrated such a conventional pulse combustion device as described above which comprises a cylindrical support member 12 forming therein a mixing chamber 16, a valve housing assembly 20 coupled with the support member 12, a flapper-type gas inlet valve 50 disposed within a cylindrical member 21 of housing assembly 20, and a flapper-type air inlet valve unit mounted on an annular flange member 25 of housing assembly 20. The cylindrical member 21 forms therein a gas passage 22 in open communication with the mixing chamber 16, and the flange member 25 forms therein an annular space **26*a* and is formed with a plurality of circumferentially equi-spaced openings 26*b*. The annular space 26*a* and openings 26*b* are arranged to form a plurality of circumferentially equi-spaced air flow passages 26 in surrounding relationship with the gas passage 22. The air inlet valve unit includes an annular valve plate 1 secured to the cylindrical member 21 and flange member 25, an annular perforated backer plate 3 fixed to the valve plate 1 through annular spacers 5, and an annular air flapper 4 movable between the valve plate 1 and backer plate 3. As shown clearly in FIG. 4, the valve plate 1 is formed with a plurality of circumferentially equi-spaced radial slots 2 for allowing the flow of air passing therethrough from the air flow passages 26 into the mixing chamber 16**.

During operation of the pulse combustion device, the air flapper 4 reciprocates in a limited space between the valve plate 1 and backer plate 3 to open and close the radial slots 2 in valve plate 1 at a frequency of pulse combustion. In general, it is desirable that the movement spacing of the air flapper 4 is ranged from about 1.2 mm to 1.6 mm to effect stable combustion of the mixture. If the movement spacing of the air flapper 4 was more than 1.6 mm, smooth reciprocation of the air flapper 4 would not be effected, resulting in unstable combustion of the mixture and in damage of the air flapper in a short period of time. For this reason, a supply amount of air is limited by the size of the air flapper 4. Meanwhile, if the air flapper was enlarged in size to increase combustion capacity of the device, smooth reciprocation of the air flapper would not be effected, resulting in unstable combustion of the mixture. For this reason, it was difficult to increase combustion capacity of the device.

SUMMARY OF THE INVENTION

It is, therefore, a primary object of the present invention to provide an improved flapper-type air inlet valve assembly for the pulse combustion device which is capable of increasing a supply amount of air without causing any problems as described above.

According to the present invention, the primary object is attained by providing a pulse combustion device wherein the air inlet valve assembly includes an annular valve plate formed with a plurality of circumferentially equi-spaced air ports and being secured to annular end surfaces of the flange member and the cylindrical member, and a plurality of circumferentially equi-spaced air inlet valve units mounted on the valve plate on a common circular path concentric with the gas passage, the air inlet valve units each including a circular perforated backer plate arranged within the mixing chamber to oppose each of the air ports and fixed to the valve plate through a spacer, and a circular air flapper movable between the valve plate and the backer plate to be lifted off the air port when applied with negative pressure in the mixing chamber and to be seated over the air port when applied with positive pressure in the mixing chamber.

BRIEF DESCRIPTION OF THE DRAWINGS

Additional objects, features and advantages of the present invention will become more readily apparent from the following detailed description of a preferred embodiment thereof when considered with reference to the accompanying drawings, in which.

DESCRIPTION OF THE PREFERRED EMBODIMENT

Figure 1:
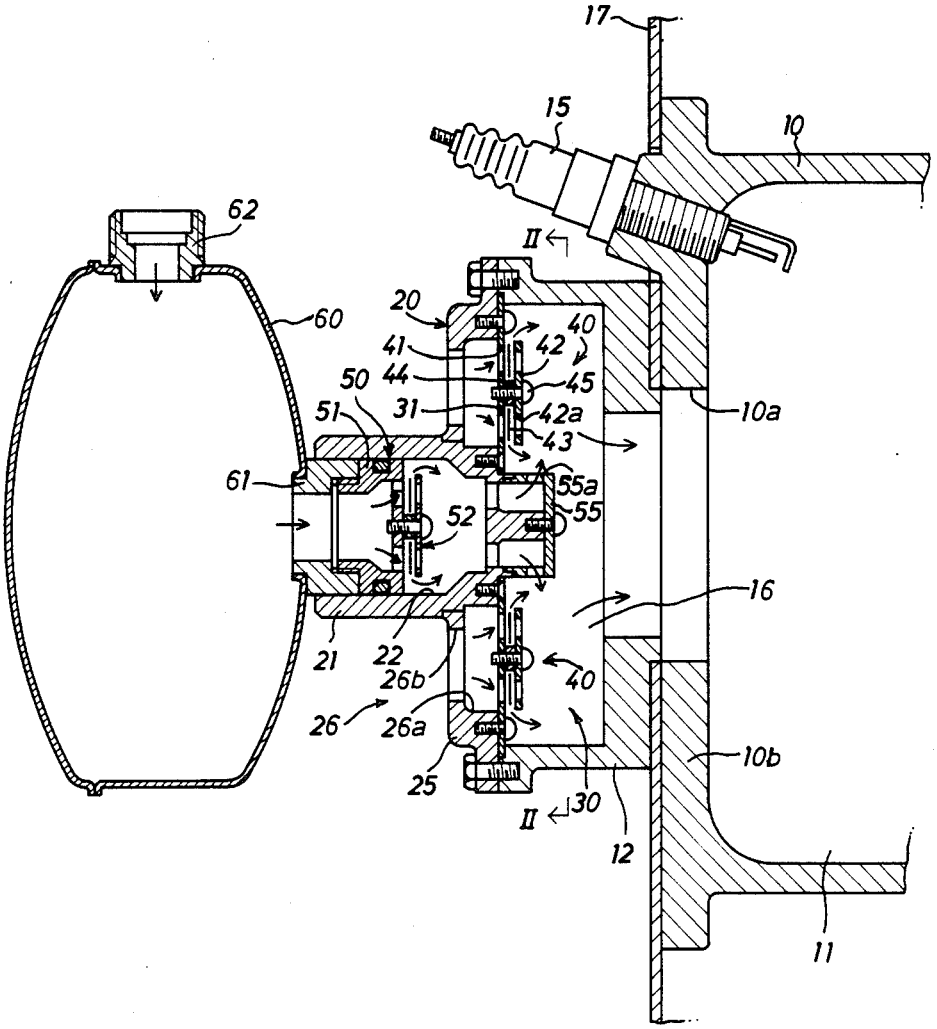
FIG. 1 is a sectional view of a pulse combustion device mounted on a cooking vessel.

Referring now to the drawings, FIG. 1 illustrates a pulse combustion device equipped with a flapper-type air inlet valve assembly 30 in accordance with the present invention. The pulse combustion device includes a housing 10 forming therein a combustion chamber 11, a cylindrical support member 12 forming therein a mixing chamber 16, and a valve housing assembly 20 coupled with an open end of support member 12. The housing 10 is disposed within a cooking vessel or pot 17 a portion of which is illustrated in the figure and has an end wall **10*b* secured in a fluid tight manner to a side wall of the vessel 17 by means of bolts (not shown). The end wall 10*b* of housing 10 is formed with an aperture 10*a* which is aligned with an aperture in the side wall of vessel 17. The housing 10 has another end wall (not shown) forming the combustion chamber 11 and supporting a tailpipe (not shown) connected thereto in a fluid tight manner. The tailpipe is fully immersed in an amount of liquid such as cooking oil or water stored in the vessel 17. The tailpipe is arranged to receive combustion products from the combustion chamber 11 and extends outwardly from another side wall of the vessel 17 to deliver the combustion products to an exhaust. A spark plug 15 is mounted on the end wall 10*b* of housing 10 and has an electrode located in the combustion chamber 11**.

The support member 12 has a bottom wall formed with an aperture for communication between the mixing chamber 16 and the combustion chamber 11 and is joined in a fluid tight manner to the end wall 10*b* of housing 10 through the side wall of vessel 17 by means of bolts (not shown). The valve housing assembly 20 includes an annular flange member 25 secured to the open end of support member 12 in a fluid tight manner by means of bolts, and a cylindrical member 21 welded in the center of flange member 25. The cylindrical member 21 of housing assembly 20 is formed therein with a gas passage 22 in open communication with the mixing chamber 16 in support member 12. The flange member 25 forms therein an annular space 26*a* in surrounding relationship with the cylindrical member 21 and is formed with a plurality of circumferentially equi-spaced openings 26*b*. The annular space 26*a* and openings 26*b* are arranged to form a plurality of circumferentially equi-spaced air flow passages 26 in surrounding relationship with the gas passage 22.

Figure 2:
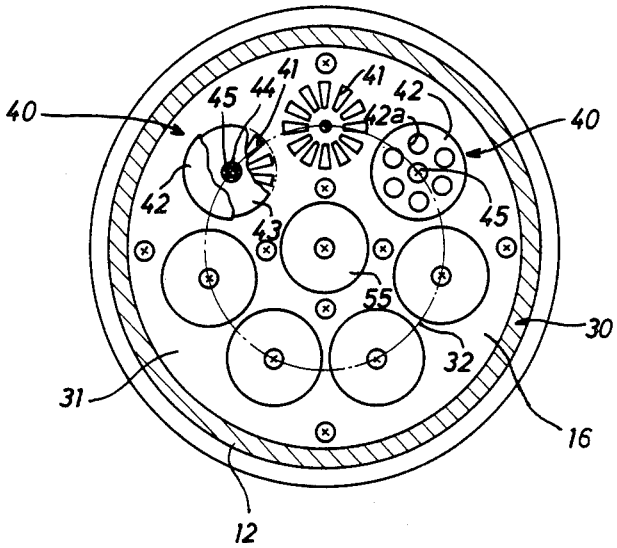
FIG. 2 is a cross-sectional view taken along line II—II in FIG. 1, illustrating component parts of a flapper-type air inlet valve assembly in the pulse combustion device.

The flapper-type air inlet valve assembly 30 is mounted on the flange member 25 of valve housing assembly 20 to permit inward flow of air passing therethrough from the air flow passages 26 into the mixing chamber 16 and to block outward flow of fuel-air mixture from the mixing chamber 16. As shown in FIGS. 1 and 2, the air inlet valve assembly 30 includes an annular valve plate 31 secured to annular end surfaces of the cylindrical housing 21 and flange member 25 by means of screws, and a plurality of circumferentially equi-spaced valve units 40 mounted on the valve plate 31. The valve plate 31 is formed with a plurality of circumferentially equi-spaced circular air ports 41 which are each formed by a plurality of circumferentially equi-spaced radial slots and located on a common circular path concentric with the gas passage 22. The valve units 40 each includes a circular backer plate 42 arranged within the mixing chamber 16 to oppose each of the air ports 41 and fixed to the valve plate 31 through a spacer 44 by means of a screw 45, and a circular air flapper 43 movable between the valve plate 31 and the backer plate 42. The circular backer plate 42 is located within the interior of mixing chamber 16 and is slightly larger in diameter than the circular air port 41.

As shown clearly in FIG. 2, the backer plate 42 is formed with a plurality of circumferentially equi-spaced small holes 42*a*. The air flapper 43 is in the form of a circular flexible thin plate made of a heat-resisting fabric coated with heat-resisting synthetic resin and formed at its center with a hole through which the spacer 44 is inserted. With negative pressure in the mixing chamber 16, the air flappers 43 are lifted off the air ports 41, allowing air to flow into the mixing chamber 16 from the air flow passages 26 therethrough. During intermittent periods of positive pressure in the mixing chamber 16, the air flappers 43 are seated over the air ports 41, closing them off. The air flappers 43 each are slightly larger in diameter than the air port 41 and slightly smaller in diameter than the backer plate 42.

As shown clearly in FIG. 1, a cup-shaped gas distribution head 55 is arranged within the mixing chamber 16 and screwed to the center of cylindrical member 21. The gas distribution head 55 is formed with a plurality of circumferentially equi-spaced radial holes 55*a* for communication between the gas passage 22 and the mixing chamber 16. Disposed within the cylindrical member 21 is an outlet sleeve 61 which is secured to a gas container 60 forming therein a gas cushion chamber. The gas container 60 is provided thereon with an inlet sleeve 62 which is connected in a usual manner to a source of gaseous fuel. The outlet sleeve 61 is screwed into the gas passage 22 of cylindrical member 21 in a fluid tight manner.

Within the gas passage 22 of cylindrical member 21, a flapper-type gas inlet valve assembly 50 is coupled with the outlet sleeve 61 of gas container 60 to allow inward flow of gaseous fuel passing therethrough from the gas container 60 into the mixing chamber 16 and to block outward flow of fuel-air mixture from the mixing chamber 16. The gas inlet valve assembly 50 includes a cup-shaped valve plate member 51 screwed into the outlet sleeve 61, and a gas inlet valve unit 52 the construction of which is substantially the same as the air inlet valve unit 40. When the air flappers 43 of units 40 are lifted off the air ports 41, a gas flapper of unit 52 is simultaneously lifted off a gas port to introduce gaseous fuel into the mixing chamber 16 from the gas container 60 through the gas passage 22 and distribution head 55. When the air flappers 43 of units 40 are seated over the air ports 41, the gas flapper of unit 52 is seated over the gas port to block a reverse flow of gaseous fuel from the mixing chamber 16. In the foregoing arrangement, the support member 12, valve housing assembly 20, gas container 60 and spark plug 15 are housed within an air cushion chamber (not shown) which is provided with a blower to supply air under pressure into the interior of the air cushion chamber substantially at the same level as line pressure of the gaseous fuel.

Hereinafter, the effective area for passing the air between the air ports 41 and air flappers 43 will be described in comparison with the conventional air flapper valve unit shown in FIGS. 3 and 4. Assuming that the effective area of air flow passages 26 and the movement spacing of air flappers 43 are substantially the same as those in the conventional air flapper valve unit, other dimension of air flappers 43 in the air inlet valve units 40 will be determined as follows for comparison with the air flapper 4 in the conventional air flapper valve unit. In the case that the number of air flappers 43 is seven, the outer diameter of air flappers 43 is 23.5 mm, and the diameter of an inscribed circle of air flappers 43 is 40 mm, the effective area for passing the air between the air ports 41 and air flappers 43 is determined by an equation of $23.5\pi \times 1.5 \times 7 = 775$ mm$^2$. Meanwhile, in the case that the width of air flapper 4 in the conventional air inlet valve unit is 23.5 mm, the inner diameter of air flapper 4 is 40 mm, and the outer diameter of air flapper 4 is 87 mm, the effective area for passing the air between the air ports 2 and air flapper 4 is determined by an equation of $40\pi \times 1.5 + 87\pi \times 1.5 = 589$ mm$^2$. From the above comparison, it will be understood that the effective area for passing the air between the air ports 41 and air flappers 43 increases about 28%.

For operation of the pulse combustion device, gaseous fuel is supplied into the mixing chamber 16 from the gas container 60 through the gas inlet valve unit 52 and gas distribution head 55, while air is supplied into the mixing chamber 16 from the air flow passages 26 through the air inlet valve units 40. The gaseous fuel is mixed with the incoming air in the mixing chamber 16 and supplied into the combustion chamber 11 through the aperture 10*a*. On start up, the mixture of gaseous fuel and air is ignited by energization of the spark plug 15. The pressure of the resulting rapid combustion of the mixture closes the air inlet valve units 40 and gas inlet valve unit 52 and forces the combustion products to exhaust from the tailpipe. When resonant (pulse) combustion is initiated, oscillation takes place in the tailpipe, creating alternate positive and negative pressures in the tailpipe. During periods of negative pressure in the combustion chamber 11, the air inlet valve units 40 and gas inlet valve unit 52 are simultaneously opened to introduce fresh air and gaseous fuel into the combustion chamber 11 through the mixing chamber 16. The mixture of fresh gaseous fuel and air is reignited by a frame caused by the pulse combustion. During intermittent periods of positive pressure in the combustion chamber 11, the air inlet valve units 40 and gas inlet valve unit 52 are closed. The reignition of each fresh air-fuel mixture is continuously repeated at a frequency, for instance, about 100 cycles per second.

Figure 3:
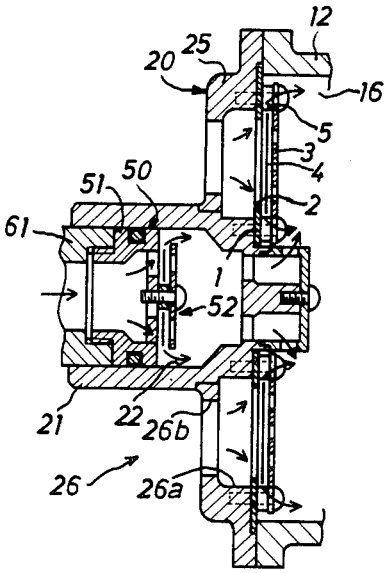
Fig. 3 PRIOR ART
FIG. 3 is a sectional view of a conventional pulse combustion device.
Figure 4:
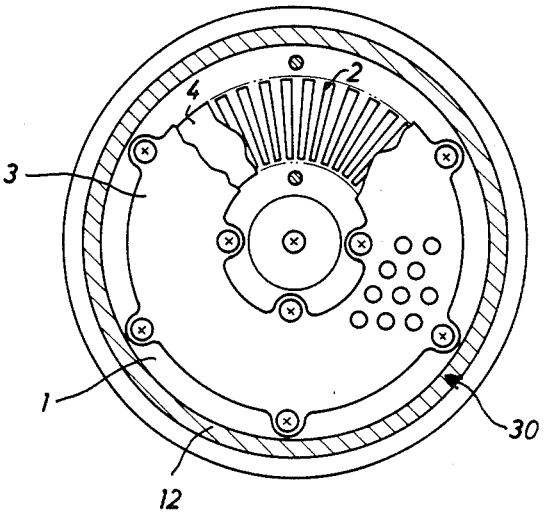
Fig. 4 PRIOR ART
FIG. 4 is a cross-sectional view of the conventional pulse combustion device, illustrating component parts of a flapper-type air inlet valve assembly adapted to the device.

In the embodiment described above, each air flapper 43 in the air inlet valve units 40 is smaller in size than the air flapper 4 in the conventional air inlet valve unit shown in FIGS. 3 and 4. For this reason, each movement of the air flappers 43 is smoothly effected in response to positive and negative pressures in the combustion chamber 11. It is, therefore, able to ensure stable pulse combustion of the mixture even if the movement spacing of air flapper 43 is enlarged to increase the amount of air flowing into the mixing chamber 16. It is also able to prevent the air flappers 43 from damage in a short period of time even if the frequency of pulse combustion is shortened due to change of the ambient condition.

Although the preferred embodiment of the present invention has been shown and described, it should be understood that various modifications and rearrangement of the parts may be resorted to without departing from the scope of the invention as dislcosed and claimed herein.

What is claimed is:

1. A pulse combustion device comprising a housing forming therein a combustion chamber, a cylindrical support member joined in a fluid tight manner to said housing to form a mixing chamber in open communication with the combustion chamber, an annular perforated flange member coupled with an open end of said support member, a cylindrical member mounted in the center of said flange member to form a gas passage in open communication with the mixing chamber, a flapper-type air inlet valve assembly mounted on said flange member to allow inward flow of air passing therethrough into the mixing chamber and to block outward flow of air from the mixing chamber, and a flapper-type gas inlet valve assembly disposed within said cylindrical member to allow inward flow of gaseous fuel passing therethrough into the mixing chamber and to block outward flow of the gaseous fuel from the mixing chamber, wherein said air inlet valve assembly includes an annular valve plate formed with a plurality of circumferentially equi-spaced air ports and being secured to annular end surfaces of said flange member and said cylindrical member, and a plurality of circumferentially equi-spaced air inlet valve units mounted on said valve plate on a common circular path concentric with the gas passage, said air inlet valve units each including a circular perforated backer plate arranged within the mixing chamber to oppose each of said air ports and fixed to said valve plate through a spacer, and a circular air flapper movable between said valve plate and said backer plate to be lifted off said air port when applied with negative pressure in the mixing chamber and to be seated over said air port when applied with positive pressure in the mixing chamber.

2. A pulse combustion device as claimed in claim 1, wherein said flange member is formed with a plurality of circumferentially equi-spaced openings to provide a plurality of circumferentially equi-spaced air flow passages in surrounding relationship with the gas passage in said cylindrical member, and wherein said backer plate is formed with a plurality of circumferentially equi-spaced small holes.

3. A pulse combustion device as claimed in claim 1, wherein said air flapper is smaller in diameter than said backer plate and larger in diameter than said air port.

4. A pulse combustion device as claimed in claim 1, wherein said air ports are each in the form of a plurality of circumferentially equi-spaced radial slots.

5. A pulse combustion device as claimed in claim 1, wherein said air flapper is in the form of a circular flexible thin plate made of a heat-resisting fabric coated with heat-resisting synthetic resin.

* * * * *